US006047838A

United States Patent [19]

Rindoks et al.

[11] Patent Number: 6,047,838

[45] **Date of Patent: *Apr. 11, 2000**

[54] MODULAR SUPPORT POST

[75] Inventors: Kurt P. Rindoks; Alan W. Stephenson, both of Statesville, N.C.

[73] Assignee: Kewaunee Scientific Corp., Statesville, N.C.

[ * ] Notice: This patent issued on a continued prosecution application filed under 37 CFR 1.53(d), and is subject to the twenty year patent term provisions of 35 U.S.C. 154(a)(2).

[21] Appl. No.: 08/818,627

[22] Filed: Mar. 14, 1997

[51] Int. Cl.[7] ..... A47F 5/00

[52] U.S. Cl. ..... 211/187; 211/189; 312/265.1; 312/265.4

[58] Field of Search ..... 211/187, 189, 211/75, 177; 312/265.1, 265.4, 257; 403/255, 217; 220/23.4

[56] References Cited

U.S. PATENT DOCUMENTS

| | | | |
|---|---|---|---|
| 3,080,980 | 3/1963 | Gibbons | 211/187 X |
| 3,513,606 | 5/1970 | Jones | 211/189 X |
| 3,648,419 | 3/1972 | Marks | 211/187 X |
| 3,655,159 | 4/1972 | Held, Jr. | 211/187 X |
| 3,733,755 | 5/1973 | Butler | 211/177 X |
| 3,835,354 | 9/1974 | Torres-Pena | 312/257 |
| 3,837,754 | 9/1974 | Malcik | 403/217 |
| 3,841,726 | 10/1974 | Andros et al. | 211/189 X |
| 4,116,509 | 9/1978 | Smith | 312/257 R |
| 4,199,070 | 4/1980 | Magnussen, Jr. | 211/189 X |
| 4,323,163 | 4/1982 | Johns | 211/189 |
| 4,403,886 | 9/1983 | Haeusler | 211/189 X |
| 4,433,884 | 2/1984 | Edwards et al. | 312/256 |
| 4,490,064 | 12/1984 | Ducharme | 403/255 |
| 4,544,214 | 10/1985 | Nizel et al. | 312/209 |
| 4,585,131 | 4/1986 | Crossman et al. | 211/189 X |
| 4,586,759 | 5/1986 | Wrobel | 312/198 |
| 4,653,652 | 3/1987 | Avati | 211/189 |
| 4,700,916 | 10/1987 | Bastian et al. | 248/225.2 |
| 4,784,552 | 11/1988 | Rebentisch | 411/85 |
| 4,830,531 | 5/1989 | Condit et al. | 403/348 |
| 4,867,320 | 9/1989 | Jonker | 211/189 |
| 4,895,331 | 1/1990 | Nehls | 248/245 |
| 4,940,149 | 7/1990 | Vineis | 211/189 X |
| 5,092,253 | 3/1992 | Grund et al. | 108/101 |
| 5,255,803 | 10/1993 | Pavon et al. | 211/189 |
| 5,292,015 | 3/1994 | Bumbera | 211/189 |
| 5,318,259 | 6/1994 | Fussler | 248/188.8 |
| 5,354,025 | 10/1994 | McCaffrey | 211/187 X |

(List continued on next page.)

FOREIGN PATENT DOCUMENTS

| | | |
|---|---|---|
| 1 410 182 | 12/1965 | France . |
| 1429599 | 11/1968 | Germany . |
| 1 2710333 | 9/1977 | Germany . |
| 27 19 874 | 11/1978 | Germany . |
| 1 2914854 | 10/1980 | Germany . |
| 92 07 552 U | 9/1992 | Germany . |
| 93 15 767 U | 2/1994 | Germany . |
| 195 20 081 | 12/1996 | Germany . |
| 1 2064305 | 6/1981 | United Kingdom . |

OTHER PUBLICATIONS

Hamilton Max Lab Furniture System—Max/Lab Furniture for the Technical Environment (pp. 1–48).

*Primary Examiner*—Daniel P. Stodola
*Assistant Examiner*—Khoa Tran
*Attorney, Agent, or Firm*—Kennedy Covington Lobdell & Hickman LLP

[57] ABSTRACT

A support post for use in a system of modular furniture, including a pair of vertically elongated post sections, with each post section including two opposed end portions in a longitudinally oriented front face portion, each of the front face portions including a mounting arrangement for mounting modular furniture components therein, and each of the end portions defining an opening and opening walls constructed and configured to releasably engage a splicing member or a foot member for splicing together of the post sections and upright positioning of the support post.

13 Claims, 8 Drawing Sheets

U.S. PATENT DOCUMENTS 5,372,265 12/1994 Monch ..... 211/187
5,381,916 1/1995 Strawder ..... 220/23.4
5,405,017 4/1995 Szabo, Sr. et al. ..... 211/189 X
5,433,327 7/1995 Benvenuti et al. ..... 211/187 X
5,470,139 11/1995 Hsiao ..... 312/265.1 X
5,478,145 12/1995 Kamachi ..... 211/187 X
5,520,292 5/1996 Lombardi ..... 211/189 X
5,564,579 10/1996 Pynenburg et al. ..... 211/187 X
5,582,306 12/1996 Balter et al. ..... 211/187
5,678,706 10/1997 Husak et al. ..... 211/189
5,690,239 11/1997 Ballard ..... 211/187 X

MODULAR SUPPORT POST

BACKGROUND OF THE INVENTION

The present invention relates to a support post for use in a system of modular furniture and, more particularly, to a support post which can be used to easily and quickly assemble a support structure for various modular furniture components.

Modular furniture systems are known, and it is typical for such systems to include a number of furniture components which can be mounted onto a support structure. The support posts which typically form part of the support structure for such modular furniture components are often main load bearing members and are therefore frequently bulky, cumbersome, and complex. Such posts can be inconvenient and difficult to transport and can create difficulties during assembly of the support structure.

Previous known modular furniture systems such as the system disclosed in Grund et al U.S. Pat. No. 5,092,253 have developed a wide number of furniture components which can be installed in the system, but have focused less on the design of the support post in the system. Attempts have been made to design improved support posts, such as the column in Fussler U.S. Pat. No. 5,318,259, but the design disclosed therein is directed more toward providing a raceway for electrical and other cables, and does not effectively address the problem of providing a support post which can be used in a modular furniture system, but which can be easily assembled.

Accordingly, a need exists for a support post which can be easily manufactured at low cost, yet has significant versatility in being easily and quickly incorporated into a support structure for modular furniture and which is capable of being readily connectable to a variety of components in a modular furniture system.

SUMMARY OF THE INVENTION

The present invention provides a support post for use in a system of modular furniture which can be readily assembled into a support structure and which allows for easy splicing of the post and quick installation of a foot member for support of the post, while incorporating an arrangement for supporting furniture components thereon.

Briefly summarized, the present invention provides a support post for use in a system of modular furniture which includes a pair of vertically elongated post sections, each post section having two opposed ends and a longitudinally oriented front face portion having an arrangement for mounting modular furniture components thereon. Each of the end portions includes a wall constructed and configured to define an opening for releasably engaging a splicing member or a foot member, thereby permitting the pair of post sections to be spliced together and positioned upright by inserting the splicing member in two of the respective openings for splicing together there at and installing the foot member in another of the openings for supporting the assembled support post thereon.

Preferably, each of the post sections defines a passage extending between opposed ends to provide the openings at each end, and also defines a continuous relief void communicating with the passage. The post sections may advantageously be formed from lightweight extruded material.

Also, the opening walls may be constructed and configured to define an opening for releasably engaging a connecting arrangement which allows two assembled support posts to be selectively connected to one another by installing the connecting arrangement in one of the openings on each of the support posts. The post sections may also include a longitudinally oriented rear face portion which is formed with a channel member constructed and configured to receive modular fasteners for fastening of various components thereon.

The mounting arrangement for mounting of modular furniture components on the front portion may include a standard having a row of spaced openings formed therein, and the support post sections are formed to provide a channel constructed and configured to receive the standard. In a preferred embodiment, the post sections may also include an abutment located adjacent each channel to provide additional support of the standard.

In accordance with a further feature of the present invention, the longitudinally extending support posts may have a generally H-shaped transverse cross-section formed by a pair of side walls extending longitudinally in spaced parallel relation and an intermediate connector wall extending between the side walls along their longitudinal extent. The outermost longitudinally extending edges of the side walls are formed with the aforesaid channels arranged in facing relation, whereby the aforesaid standards can be received and retained in the slots and connecting components can be passed through the standards and received between the side walls. The intermediate connecting wall is formed at its extending ends with the aforesaid openings for releasably engaging other connector components to allow one post to be connected to other posts.

Preferably, the outside faces of the side walls of the post are generally flat, and one of the side walls is formed with a longitudinally extending projection spaced a predetermined distance from the outermost longitudinally extending edge of such side wall, and the other side wall is formed with a groove having an interior configuration corresponding to the shape of the aforesaid projection and also being spaced from the outermost longitudinally extending edge of its side wall by a predetermined distance, these distances being such that when two posts are placed side by side in a modular support system with the projection of one post matingly secured in the groove of an adjacent post the two posts will be precisely aligned with one another without the need of measurements or tools. In some systems, a number of such aligned posts can be used, and, in addition, connectors may be used to joint such aligned posts together.

Accordingly, the present invention provides support posts having post sections which can easily be spliced together by installing a splicing arrangement in openings at end portions of two post sections and joining them together, and which can be positioned upright by installing a foot member in another of the openings on one of the post sections. Furniture components can be readily mounted on the mounting arrangements of the front face portions of the support posts. In the preferred embodiment, the openings can also releasably engage a connecting arrangement to allow the support post to be connected to another support post, thereby forming part of a modular support structure.

DESCRIPTION OF THE PREFERRED EMBODIMENT

Figure 1:
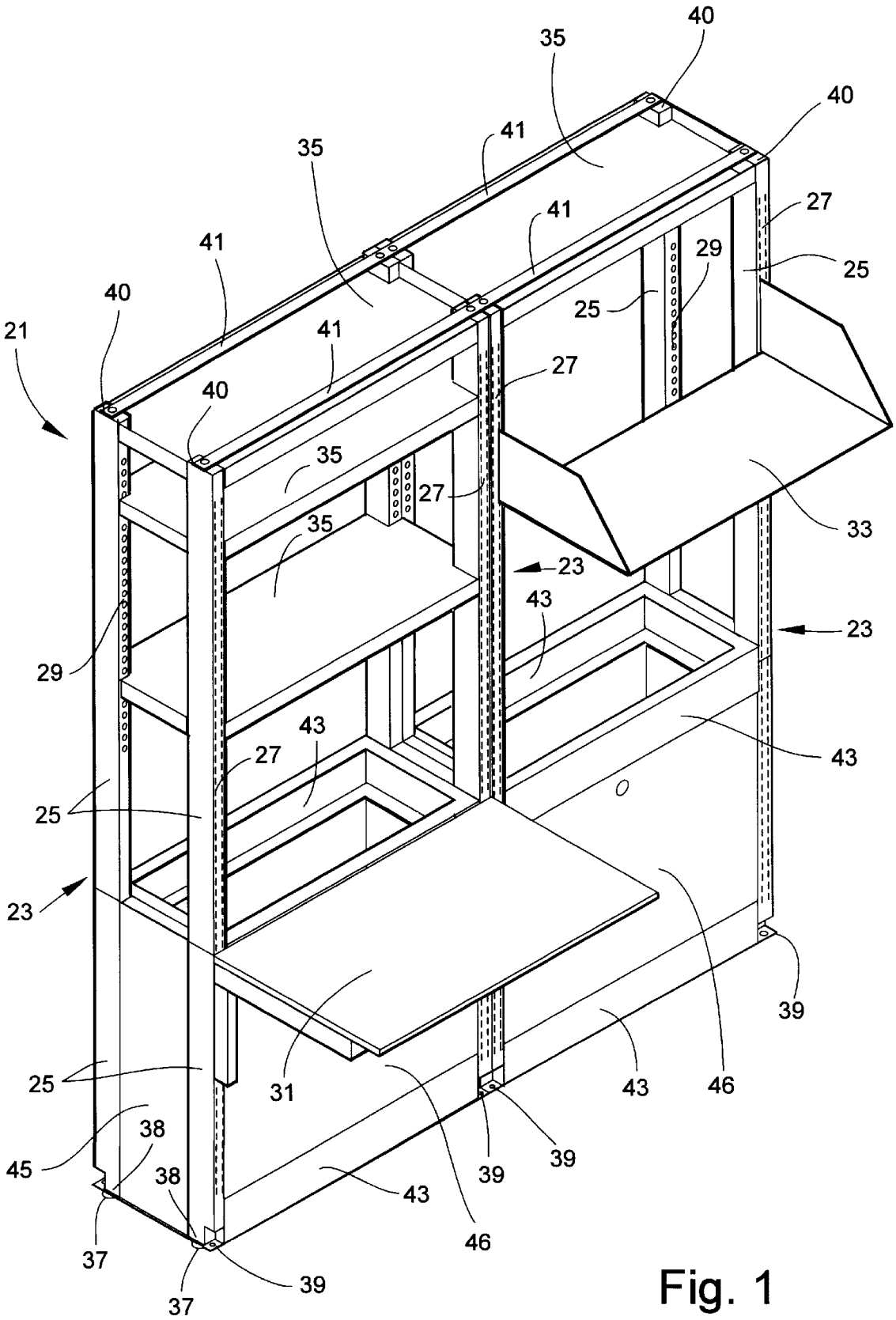
FIG. 1 is a perspective view of an assembled modular furniture structure incorporating the support posts of the present invention, with modular furniture components mounted thereon.

Referring now to the accompanying drawings, FIG. 1 shows a particular advantageous application of the support posts 23 of the present invention used in a modular furniture system 21 consisting of a number of furniture components mounted on or connected to a plurality of support posts 23 formed together in different configurations. Slotted standards 27 are installed in the front face portions of the support posts 23, while round hole standards 29 are installed on the rear face portions of the posts 23.

Modular furniture components such as a desk 31, cantilever shelf 33, and cabinets (not shown) can be mounted in the slotted standards 27, while shelves 35 are mounted in the round hole standards 29 in a manner to be described in greater detail below. Support posts 23 are formed from spliced-together post sections 25, as will also be explained in detail presently.

Leveler feet 37 are installed on the lower ends 38 of the posts 23, and bottom brackets 39 connect opposed posts 23 by engaging the corresponding leveler feet 37. The bottom brackets 39 are also secured to the floor by conventional expandable floor anchors (see FIG. 5), such as are well-known and available from many sources, or other suitable method. Top connecting bars 41 are installed on the top ends 40 of the posts 23 to connect laterally spaced posts 23 to form modular furniture structure 21. The installation of leveler feet 37 and top connecting bars 41 will be discussed below in greater detail. Frames 43 also connect opposed and laterally spaced posts 23 and add further rigidity to the modular furniture structure 21. Panel 45 is mounted between posts 23, as will be explained in further detail below, on conventional modular connectors or fasteners (not shown) such as those available from the Uni-Strut Corporation of Ann Arbor, Mich., or other sources, while panels 46 are mounted by conventional snap-in fasteners.

Figure 2:
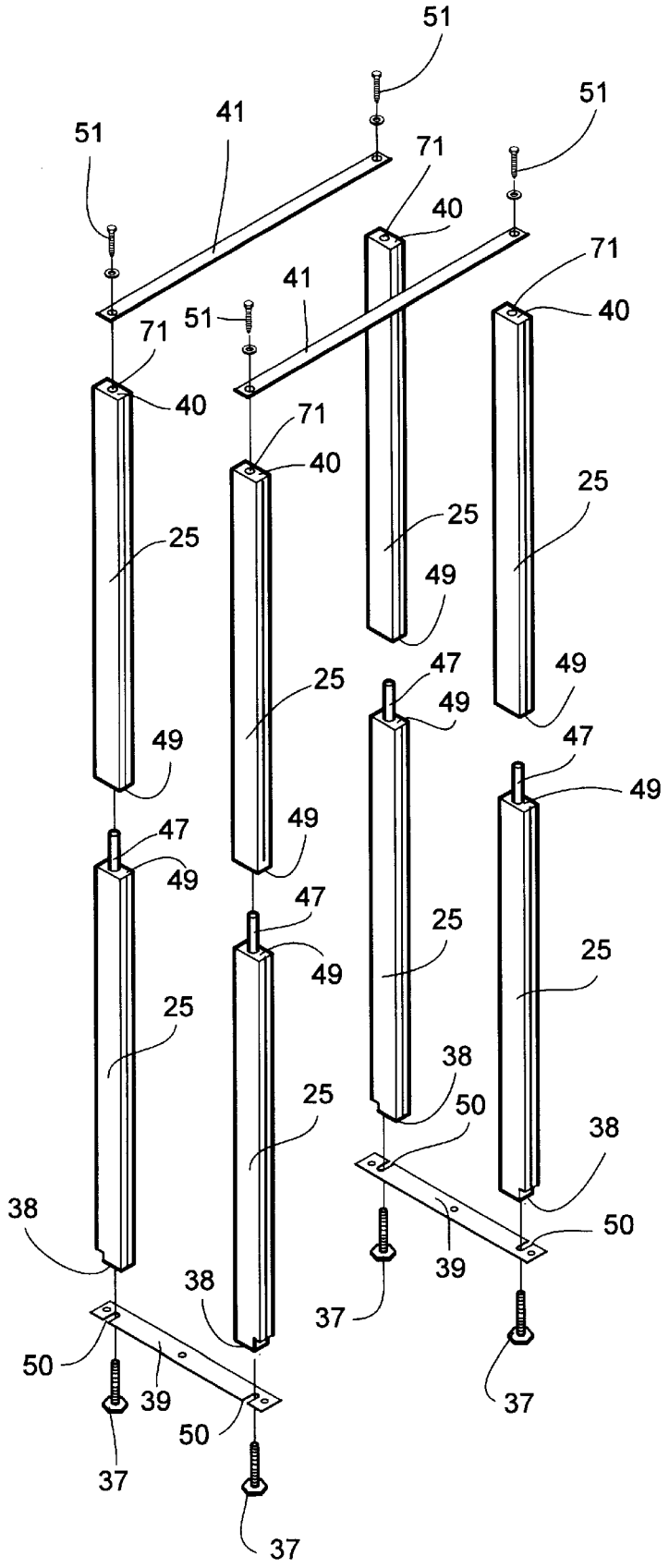
FIG. 2 is an exploded isometric view of a group of support posts of the present invention.

Turning now to FIG. 2, support posts 23 of the present invention are shown in exploded diagrammatic form, with post sections 25 separated. Post sections 25 can be of any appropriate height, and in the preferred embodiment, can be either approximately thirty-six inches or approximately forty-eight inches in height. Splicing members 47 can be seen positioned inbetween intermediate post section ends 49. At top post ends 40, connecting bolts 51 are positioned above top connecting bars 41 for installation thereof. Bottom brackets 39 are positioned to engage leveler feet 37 in elongated slots 50. Slotted standards 27 and round hole standards 29 have been omitted from FIG. 2 for clarity of illustration.

Figure 3:
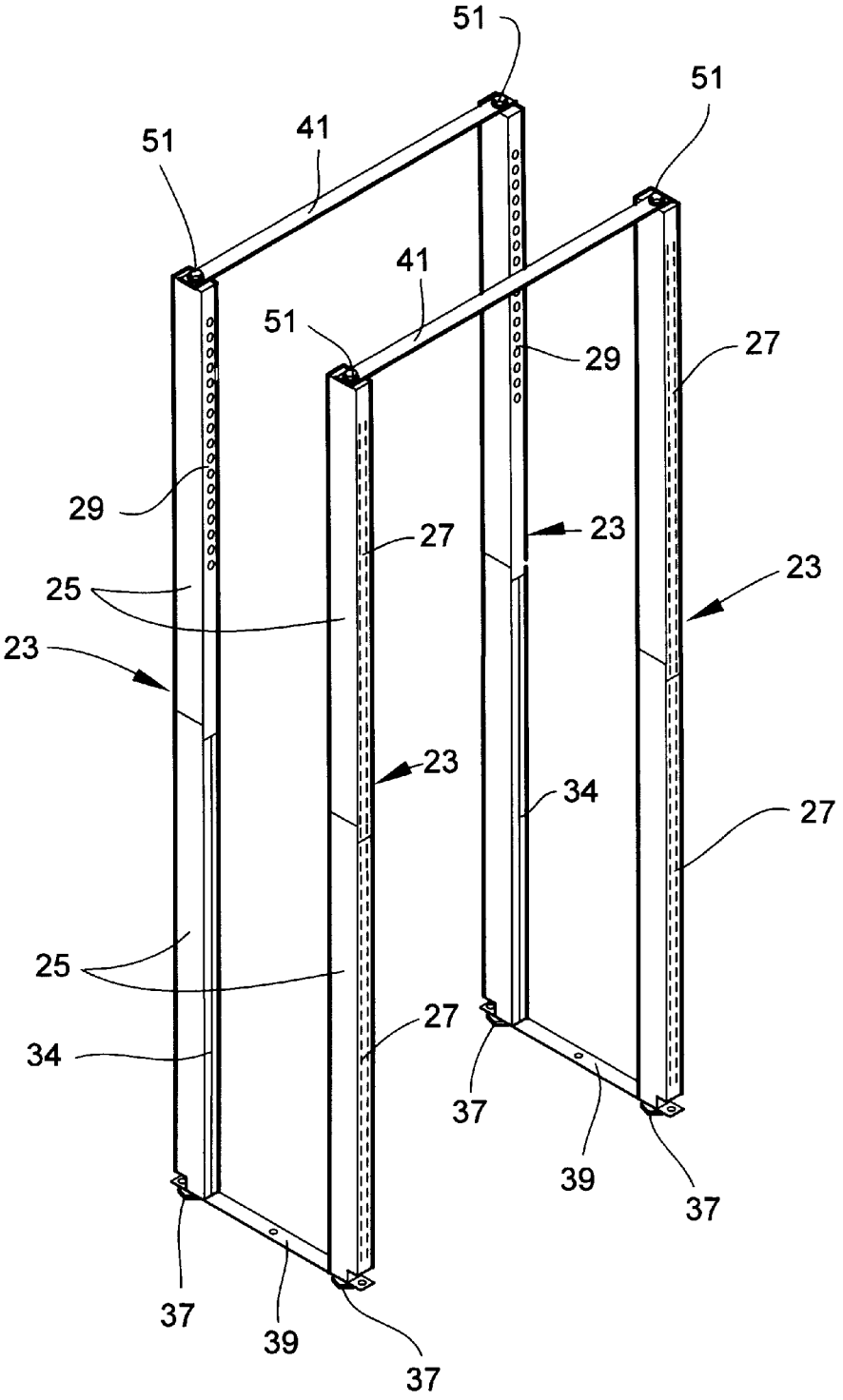
FIG. 3 is an assembled isometric view of the support posts of support 2.

FIG. 3 depicts the post sections 25 and other components of FIG. 2 in assembled diagrammatic form and with slotted standards 27 and round hole standards 29 installed. Connecting bolts 51 are installed in the top ends 40 so as to attach connecting bars 41 to the posts 23. Likewise, leveler feet 37 and bottom brackets 39 have been installed at lower ends 38 so that the posts 23 are supported thereon. Round hole standards 29 have been omitted from the lower extent 34 of the rear face portions of posts 23, so as to allow for installation of the above-mentioned modular connectors (not shown) for mounting of panels 45.

Figure 4:
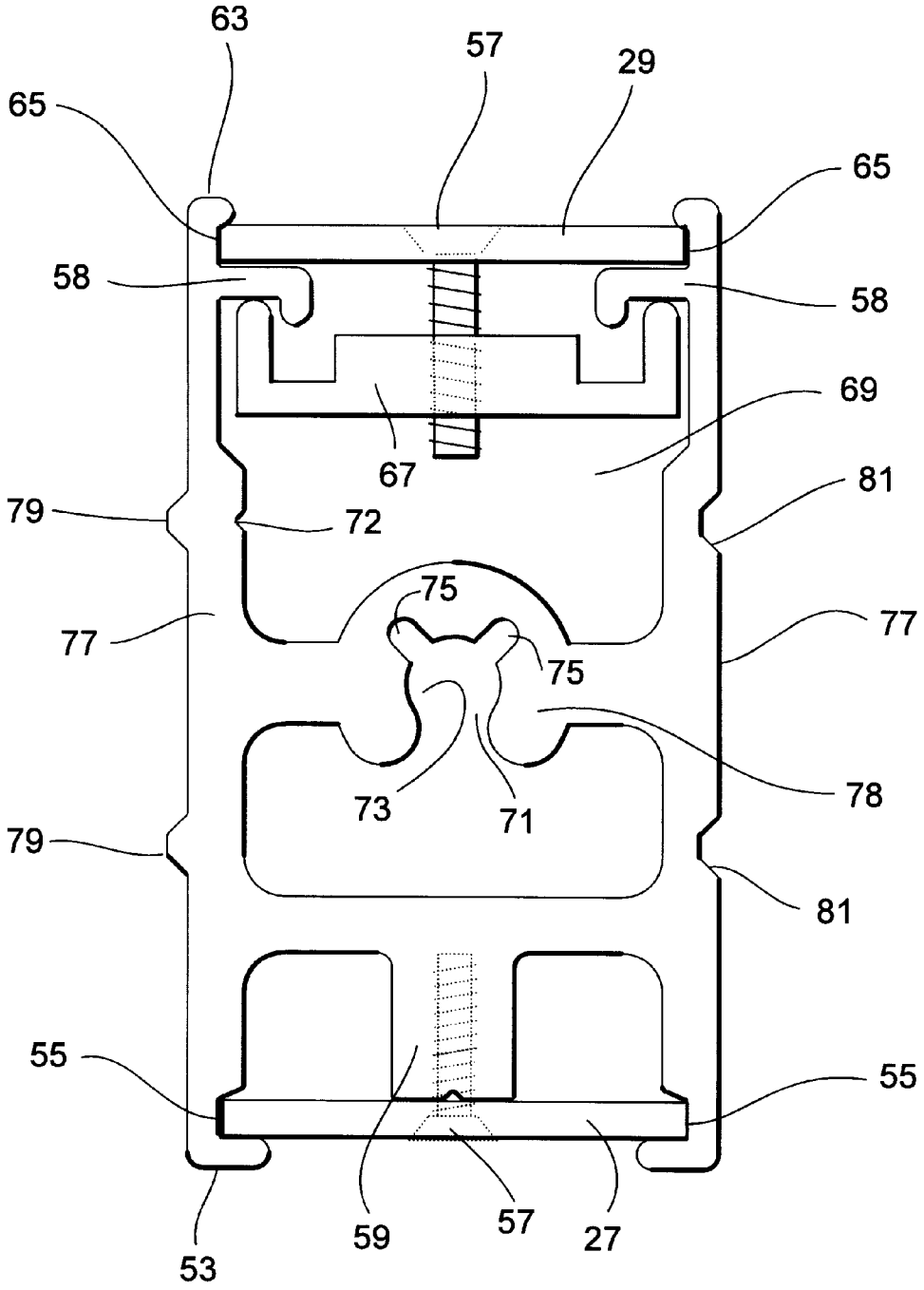
FIG. 4 is a cross-sectional view of a support post embodying the present invention.

FIG. 4 illustrates the transverse cross-section of post section 25, which is generally H-shaped and formed by a pair of side walls 77 extending longitudinally in spaced parallel relation and an intermediate connector wall 78 extending between the side walls along the longitudinal extent thereof, and the outermost longitudinally extending edges of the side walls 77 are formed with slots or channels 55 and 65, respectively, arranged in facing relation to receive and support the slotted standard 27 at front face portion 53 and the round hole standard 29 at rear face portion 63, respectively. The slotted standard 27 is fixed in place by conventional bolts 57 threaded into a longitudinally extending abutment wall 59 which adds support at the midpoint of the slotted standard 27, and the round hole standard 29 is fixed in place by bolts 57 threading into a conventional modular connector 67 which bears against the back side of shoulders 58 when such bolts 57 are tightened. Void 69 is configured to accept a wide variety of modular connectors for supporting of standards 27,29, panels 45, and many other components. The slots or channels 55 and 65 of two spliced-together post sections 25 form a continuous slot or channel extending along both post sections 25.

The intermediate connector wall 78 is formed with a passage 73 that preferably extends the entire longitudinal length thereof to provide openings 71 at the ends of post section 25, and relief voids 75 are provided along the passage 73 to assist tapping of threads in openings 71 or driving of connectors therein, all as explained in greater detail below.

Parallel side walls 77 are formed with projections 79 on one side wall 77 which are located at predetermined distances from the outermost longitudinally extending ends thereof, and grooves 81 are formed in the other side wall 77 and located a corresponding predetermined distance from the outermost longitudinally extending ends thereof. Projections 79 and grooves 81 are constructed and configured for mating engagement so that, as will be explained in more detail below, adjacent post sections 25 can be aligned by engagement of projections 79 on one post section 25 in grooves 81 on the other post section 25.

Figure 5:
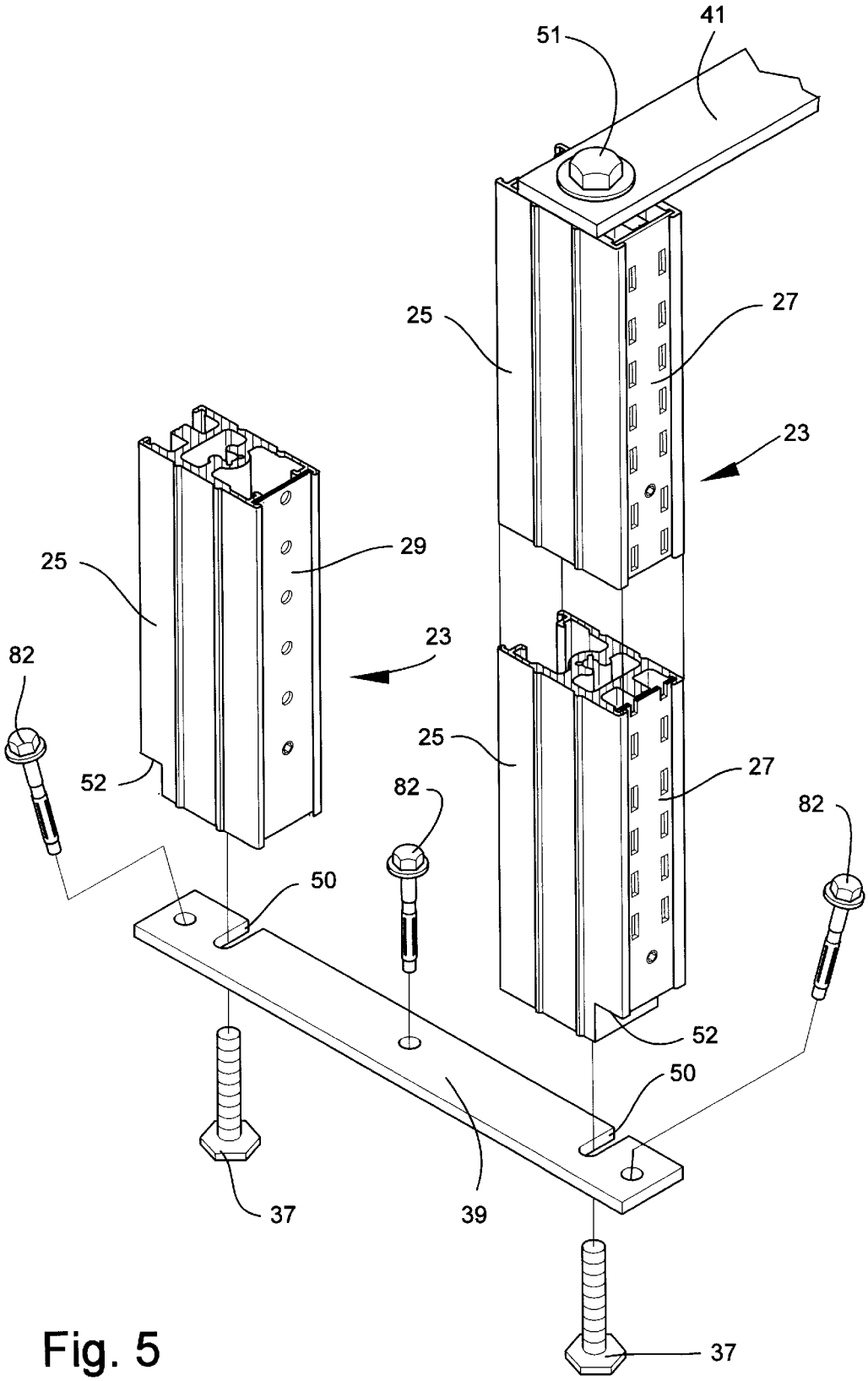
FIG. 5 is an exploded detail view of a mounting arrangement for support posts embodying the present invention.

FIG. 5 shows, in a detail exploded view, top connecting bolt 51 inserted in the opening 71 (not shown) at top post end 40, and leveler feet 37 positioned to be inserted in the openings 71 (not shown) at lower ends 38. The top connecting bar 41 is secured to the top end 40 by the top bolt 51, while the bottom bracket 39 is positioned to engage leveler feet 37 in elongated slots 50, and to then be attached to the floor through installation of conventional expandable floor anchors 82, such as are widely available. Notches 52 in the lower ends 38 of post section 25 allow clearance space for floor anchors 82 during installation. Installed floor anchors 82 thus securely attach bottom bracket 39 to the floor, and bracket 39 in turn engages leveler feet 37 to secure the posts 23 to the floor.

Figure 6:
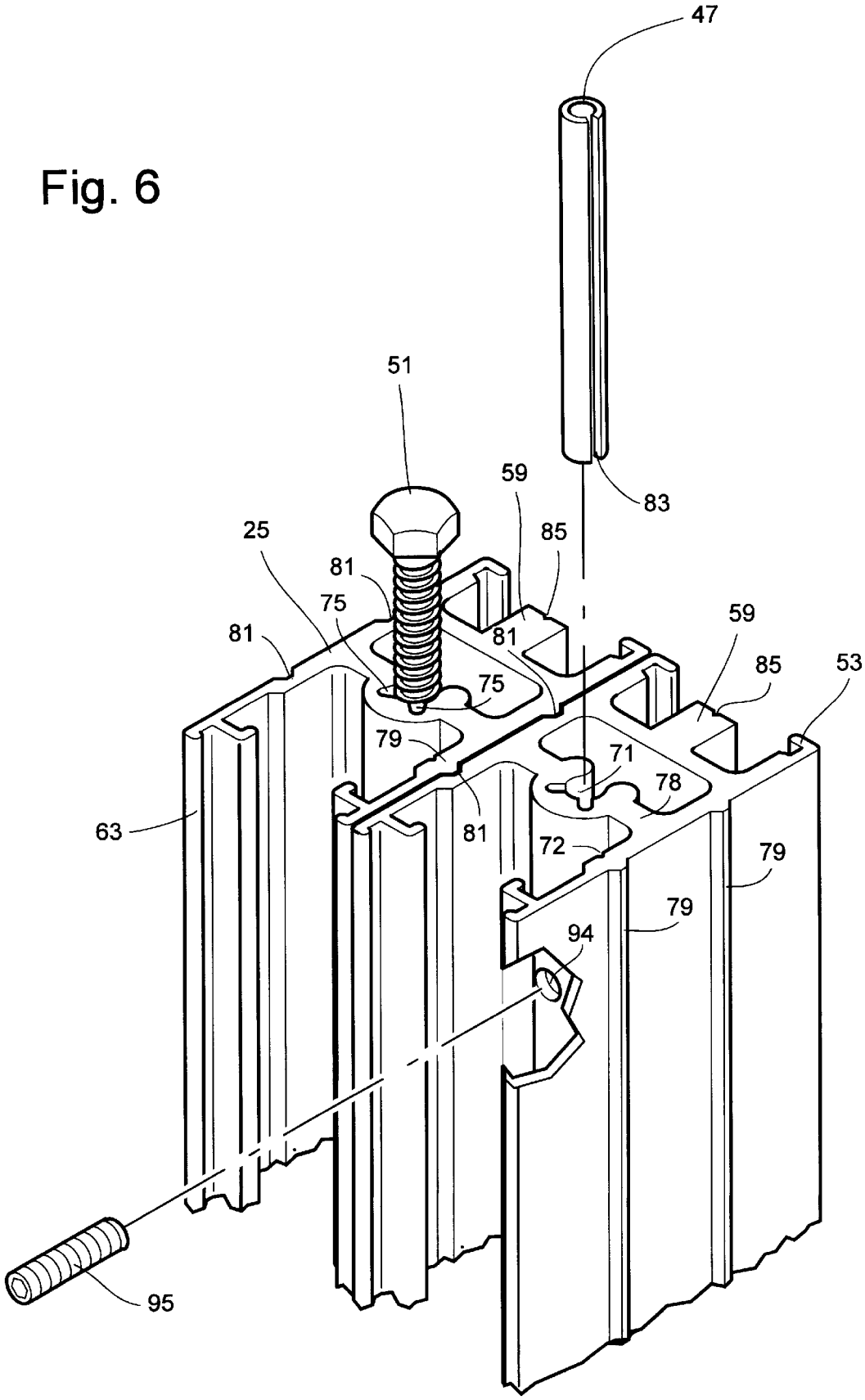
FIG. 6 is an exploded detail view of the end portions of two support posts of the present invention which are engaged and aligned with each other.
Figure 7:
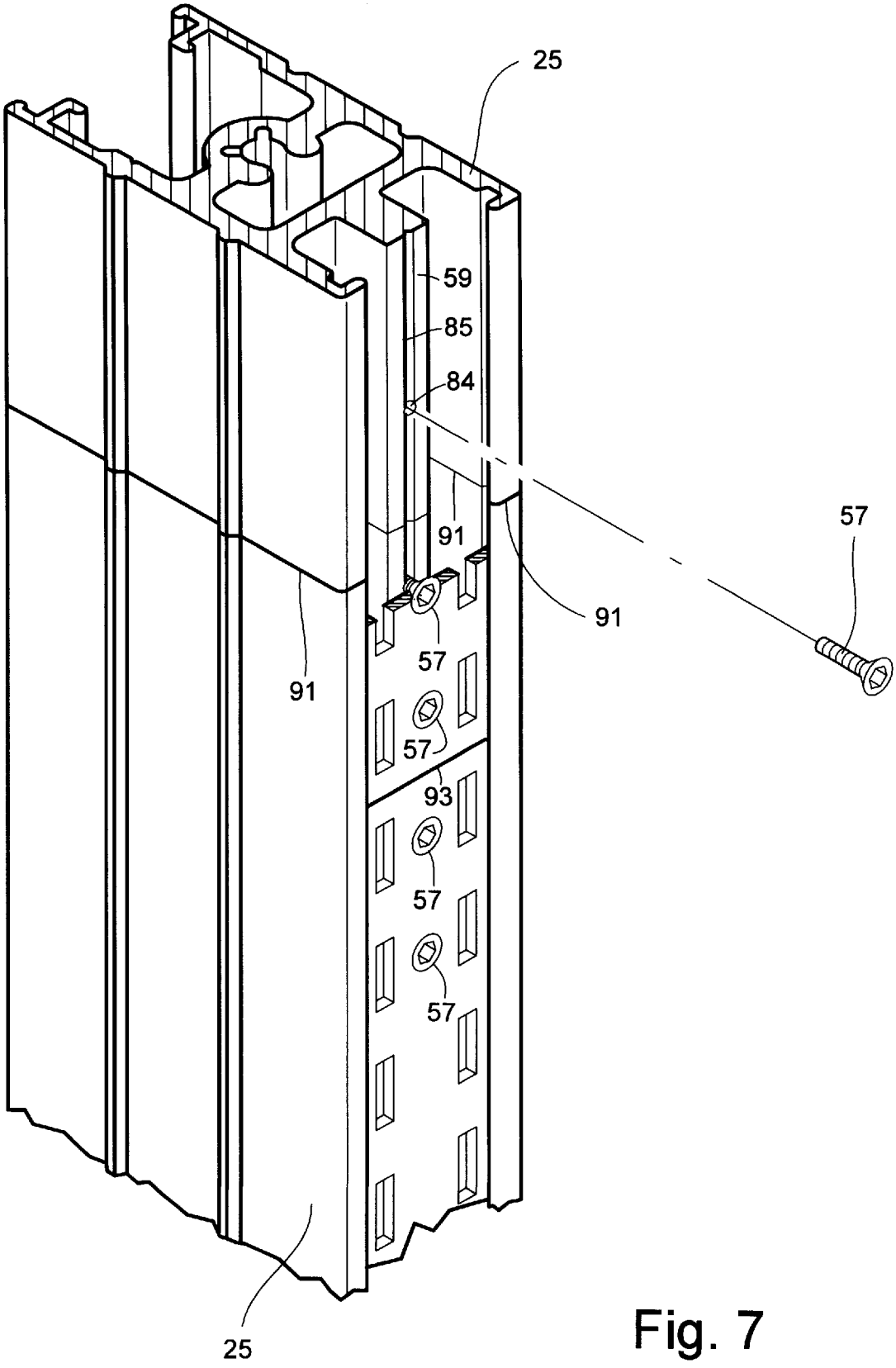
FIG. 7 is a detail exploded view of the support post of FIG. 5, with the standard partially cut away.

Each aforesaid splicing member 47, as shown in FIG. 6, consists of a conventional pin of rolled steel having an open seam 83 to allow deformation of the splicing member upon insertion in the opening 71. Set screw 95 is installed in hole 94 formed by intermediate connecting wall 78 to provide a depth stop for splicing member 47. A top connecting bolt 51 is also shown in FIG. 6 with top connecting bar 41 omitted to illustrate the relief void 75 adjacent connecting bolt 51. It is not ordinarily contemplated that top connecting bolt 51 and splicing member 47 would be installed adjacent one another, although such an arrangement is possible. In the event it is desired to install a connector attaching two adjacent post sections to each other, interior grooves 72 allow for accurate drilling of an appropriate bore across the width of post sections 25.

In the preferred embodiment of the present invention, the abutment wall 59 is formed with a guide groove 85 extending along its longitudinally extending length at the transverse midpoint thereof. Accordingly, whenever a threaded fastener 57 is to be threaded into the abutment wall 59 to hold slotted standard 27 in place, as described above, the centrally located guide groove 85 can be used to guide a drill or similar tool (not shown) for forming a bore 84 for the fastener 57 at the precise midpoint of abutment wall 59 so that even a large diameter fasecurely will be securely supported within the abutment wall because it is centered and has an equal thickness of abutment wall on both sides of the fastener 57, as compared with a non-centered location in which the wall thickness on one side wall will be thinner and therefore more subject to destruction by load bearing on the fastener 57.

Figure 8:
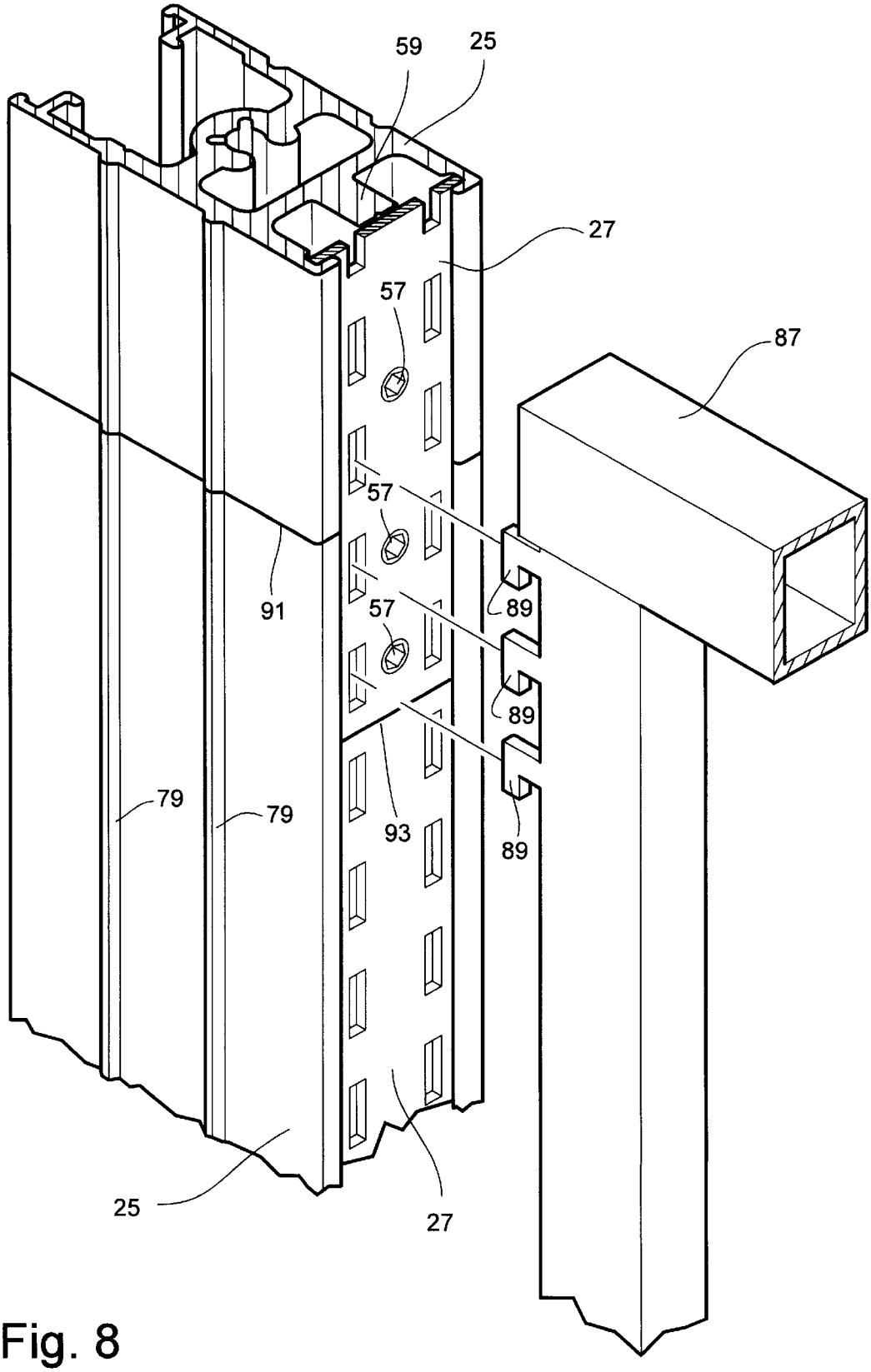
FIG. 8 is a detail exploded view of a support post of the present invention and a support bracket for a furniture component to be installed on the support post.

In FIG. 8, a furniture component mounting bracket 87 with mounting hooks 89 is shown positioned for engagement in the slotted standard 27. In addition, the abutting ends of two post sections 25 are spliced together at splice joint 91, while the slotted standard 27 overlaps splice joint 91 by a longitudinal extent and reaches a standard joint 93 which is spaced from splice joint 91. The overlapping portion of the slotted standard 27 is fixed to the abutment wall 59 by two threaded fasteners 57, thereby adding additional strength to the splice joint 91 and avoiding the creation of a plane of weakness at such splice joint 91.

The support post 23 of the present invention is, in addition to being modular and quite versatile in serving many functions, also easily assembled to construct a modular support structure for furniture components. Splicing of the post sections 25 to form posts 23 is easily accomplished by driving splicing members 47 into openings 71 and then fitting corresponding posts sections 25 over the projecting length of the splicing members 47 to form a spliced unitary post 23. In order to position the splicing members 47 at the correct depth and the openings 71, set screws 95 are first inserted at the appropriate depth so as to form a depth stop for splicing members 47, as noted above and shown in FIG. 6.

For installation of the top connecting bolts 51 and the leveler feet 37, the openings 71 at the top ends 40 and lower ends 38 of the posts 23 are first tapped to form appropriate threads therein and top connecting bolts 51 and leveler feet 37 are then threadedly engaged in the corresponding openings 71, although it must be noted that other generally equivalent methods of creating a threaded engagement, such as driving of self-threading screws in openings 71, are within the scope of the present invention. Once leveler feet 37 have been installed, they are adjusted to level the modular support structure, and bottom bracket 39 is installed as described above to anchor the structure to the floor.

Installation of the slotted standards 27 is accomplished, in the preferred embodiment, by drilling bores at the appropriate locations along the abutment aligning groove 85 on the abutment 59, tapping the bores thereby formed to form threads therein, and then threadedly engaging the threaded fasteners 57 in the threaded bores. Allen head machine bolts have been found to provide excellent performance as the threaded fasteners 57. It should be noted again that other fasteners and other methods of attaching the slotted standards 27 to the abutments 59, such as driving self-threading screws, are within the scope of the present invention.

Round hole standards 29 are, as discussed above, mounted in rear face portions 63 of the post sections 25 by use of modular connectors 67. It should be noted that slotted standards 27 can also be installed in rear face portions 63 through use of modular connectors 67, when desired. Portions of rear face 63 may also be left with no standard installed therein, as noted above, and a variety of known modular connectors can be installed therein to support components such as panels 45, or pipes, cables, electrical receptacles, and other items.

Once the desired slotted standards 27 and round hole standards 29 are in place, the appropriate modular furniture components are then mounted on the posts 23. As shown in FIG. 8, conventional mounting brackets 87 with hooks 89 are easily mounted in the slotted standard 27 and thereby provide significant load-bearing capacity for components such as the desk 31, cantilever shelves 33, or many other furniture components as illustrated in FIG. 1. Shelves 37 and other appropriate modular components can easily be positioned in the holes of the round hole standard 29 at adjustable locations.

The basic four-post configuration shown in FIG. 3 can also easily be combined to form a larger modular support structure, as depicted in FIG. 1. Adjacent posts 23 can be aligned through engagement of the side wall projections 79 in a post section 25 with corresponding side wall grooves 81 in an adjacent post section 25, as depicted in FIG. 6 to achieve the larger structure shown in FIG. 1. Mating engagement of projections 79 and grooves 81 provides alignment of the adjacent post sections with each other so as to create a modular support structure which can mount furniture components in correctly aligned and arranged configuration and also adds considerable strength by allowing adjacent post sections to jointly carry loads. Projections 79 and grooves 81 thus provide for easy, quick, and highly accurate alignment of adjacent post sections 25 with each other and forming of a high-strength structure, without requiring the use of additional tools, jigs, or aligning devices.

The support posts 23 of the present invention can be advantageously formed from lightweight metal, such as aluminum or other appropriate alloy, although the use of other materials is within the scope of the present invention. Lightweight metals may be employed to form the posts 23 of the present invention through an extrusion process, which allows efficient and economical production of a high volume of posts. The configuration of the posts 23 of the present invention, as shown in cross-section in FIG. 4, which includes only one fully enclosed void, can be easily and simply formed in the aforementioned extrusion process.

The design of the posts 23 of the present invention has numerous significant advantages. Post sections can be easily spliced together to form a post of sufficient height for use in a modular support structure, yet the relatively smaller size of each post section allows them to be economically and conveniently transported. The same post section design can be used for both the upper and lower sections 25 of the post 23, given that each post section will accept installation of leveler feet, splicing members, and top connecting screws. Moreover, the assembled support posts permit mounting of a broad variety of furniture components and modular connectors on its front and rear face portions.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A support post for supporting modular furniture components, comprising:

two elongate post sections each having opposed longitudinally spaced ends, a said end of each said post section defining an opening extending from said end longitudinally through said post section, each said post section further defining an opening extending from a side of said post section through said post section transverse to and intersecting said longitudinally extending opening thereof;

two stop members, each extending within a said transverse opening of a respective said post section into a said longitudinally extending opening thereof for obstructing said longitudinally extending opening; and a splicing member having opposed end faces, each said end face of said splicing member respectively extending within a said longitudinally extending opening of said post sections, the extension of said splicing member within each said longitudinally extending opening of said post sections being limited by blocking abutment of a said end face of said splicing member against a said stop member.

2. A support post according to claim 1, wherein said splicing member is resilient in a direction transverse to the length of the support post.

3. A support post according to claim 2, wherein said splicing member comprises a pin of rolled sheet material.

4. A support post according to claim 3, wherein said pin includes an opened seam.

5. A support post according to claim 1, wherein each said stop member comprises a set screw.

6. A support post according to claim 1, wherein each said post section includes two generally planar, parallel side walls extending longitudinally between said opposed ends thereof, a first of said two side walls including a projection extending longitudinally therealong and a second of said two side walls including a groove extending longitudinally therealong whereby another support post having a corresponding groove or projection may be aligned in abutting relation along a said side wall of the support post.

7. A support post for supporting modular furniture components, comprising:

two elongate post sections each post section including opposed longitudinally spaced ends, a said end thereof defining an opening therein;

a splicing member extending within said opening of each said post section to connect said post sections together to define a length of the support post;

a standard having locations for mounting modular furniture components, said standard extending longitudinally along and in abutment with both said post sections and bridging the connection between said post sections; and fasteners fixedly securing said standard to said post sections for reinforcement of the bridged connection between said post sections.

8. A support post according to claim 7, wherein each said post section includes two side walls connected by an intermediate wall, said side walls and said intermediate wall extending longitudinally between said opposed ends of said post section and defining an H-shaped cross-section of said post section; and wherein said standard extends in abutment with said side walls of both said post sections.

9. A support post according to claim 8, wherein said standard extends within slots defined by said side walls.

10. A support post according to claim 8, wherein said intermediate wall defines said opening at said end of said post section for receipt of said splicing member.

11. A support post according to claim 8, wherein a said post section further includes an abutment wall extending between said side walls adjacent said intermediate wall, a said fastener extending through said standard into said abutment wall for mounting of said standard in fixed disposition to said post section.

12. A support post according to claim 11, wherein said abutment wall includes a longitudinally extending groove for guiding insertion of said fastener when mounting said standard.

13. A support post according to claim 7, wherein each said post section includes two generally planar, parallel side walls extending longitudinally between said opposed ends thereof, a first of said two side walls including a projection extending longitudinally therealong and a second of said two side walls including a groove extending longitudinally therealong whereby another support post having a corresponding groove or projection may be aligned in abutting relation along a said side wall of the support post.

* * * * *